United States Patent [19]

Adams

[11] 3,990,385

[45] Nov. 9, 1976

[54] SELF-STEERING MECHANISM

[76] Inventor: Andrew C. Adams, 159 Cherry St., Fall River, Mass. 02720

[22] Filed: Dec. 17, 1975

[21] Appl. No.: 641,449

Related U.S. Application Data

[63] Continuation-in-part of Ser. No. 440,394, Feb. 7, 1974, abandoned.

[52] U.S. Cl. ..... 114/144 C; 114/150

[51] Int. Cl.[2] ..... B63H 25/04

[58] Field of Search ..... 114/150, 146, 144 R, 114/144 C, 163, 39, .5 R; 417/334, 336, 35

[56] References Cited

UNITED STATES PATENTS

| | | | |
|---|---|---|---|
| 1,681,415 | 8/1928 | Lee | 114/163 |
| 2,583,407 | 1/1952 | Binder | 114/144 R X |
| 2,972,956 | 2/1961 | Newton | 417/336 |
| 3,130,677 | 4/1964 | Liebhart | 417/336 X |
| 3,180,298 | 4/1965 | Gianoli | 114/144 C |
| 3,619,632 | 11/1971 | Labombarde | 114/39 |

*Primary Examiner*—Trygve M. Blix
*Assistant Examiner*—Sherman D. Basinger
*Attorney, Agent, or Firm*—Barlow & Barlow

[57] ABSTRACT

A self-steering mechanism for a sailboat comprising the combination of a wind vane mounted for rotation about a substantially vertical axis, which wind vane is coupled to a differential hydraulic pressure regulator. A hydraulic motor and pump is provided, the pressure regulator being located in between the motor and pump. The arrangement is such that the hydraulic pump, which can be driven by movement of the vessel through the water, the wind or other suitable sources, provides the hydraulic pressure required to operate the hydraulic motor, which motor is controlled by a differential hydraulic pressure regulator that is mechanically coupled to the wind vane. In this fashion the sailboat rudder which is coupled to the hydraulic motor can be controlled relative to the angle of attack of the wind against the wind vane.

7 Claims, 14 Drawing Figures

FIG. 2
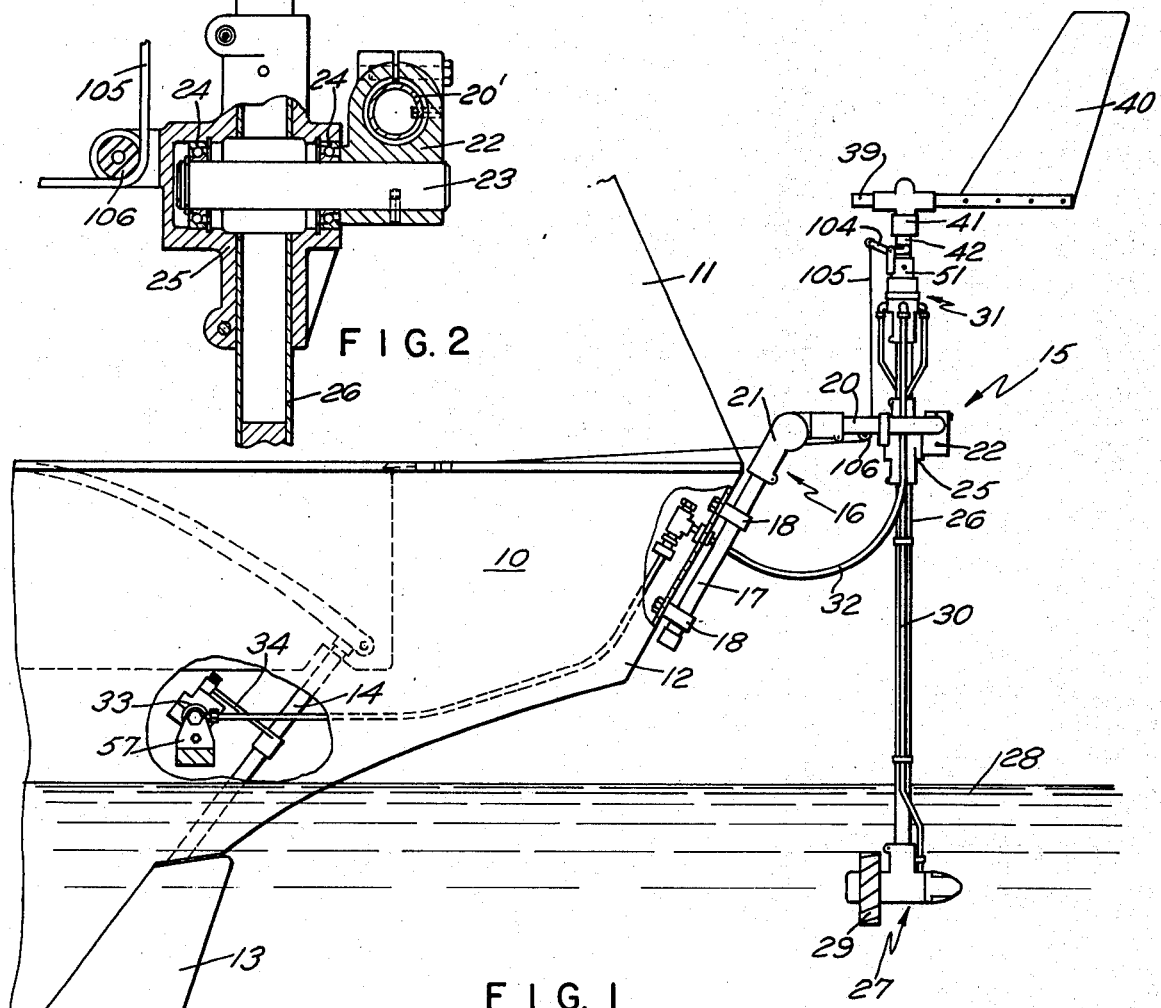
FIG. 1
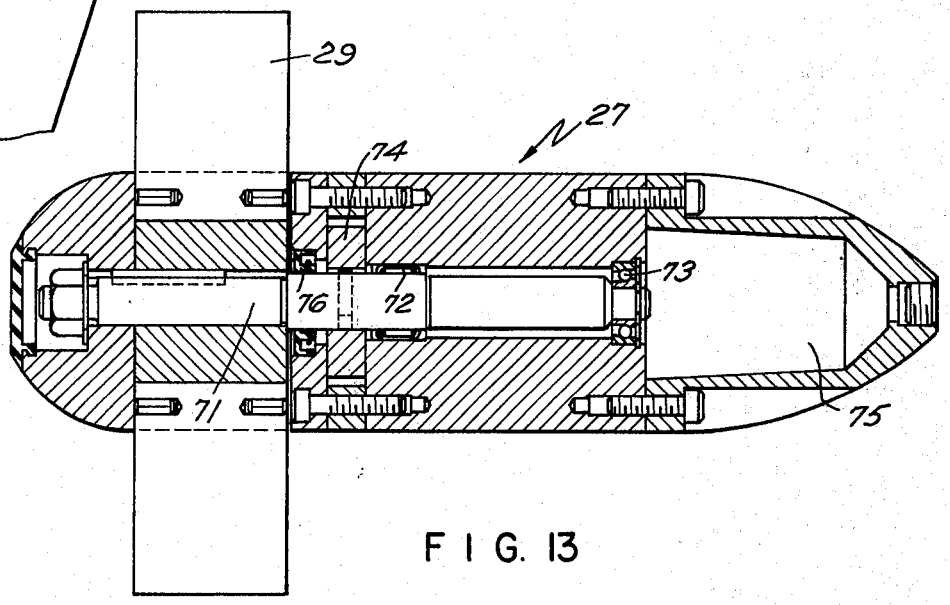
FIG. 13

SELF-STEERING MECHANISM

CROSS REFERENCE TO RELATED APPLICATION

This application is a continuation-in-part of my earlier filed application Ser. No. 440,394, filed Feb. 7, 1974 and now abandoned.

BACKGROUND OF THE INVENTION

This invention relates to self-steering mechanisms for boats and more particularly to a wind vane sensitive type of steering mechanism which controls a differential hydraulic pressure regulator that in turn will control the operation of a hydraulic motor attached to the rudder.

Autopilots and wind vane gears are the two broad classifications of existing self-steering equipment. There are a number of manufacturers of autopilots and of vane gears. The autopilots are battery operated, which makes them a good choice for power boats, but they cannot be considered to be a practical solution for the cruising sailboat.

There are currently four general types of vane gear systems.

1. Vane to Tiller - The vane is connected directly to the main rudder via the tiller. This system is used on small boats, or boats with a balanced rudder, or boats that have a light helm.
2. Trim Tab - It can be hung independently aft but is usually pivoted on the trailing edge of the main rudder. The trim tab is controlled by the wind vane. The system can be used only on boats that have an outboard rudder. The tiller is left free.
3. Auxiliary Rudder - A small rudder is hung on the stern and connected by linkage to the wind vane for control. This small rudder may have a trim tab control as per type 2. The boat's unbalance must be removed at the main rudder by securing the tiller or wheel. A change of tack, and possibly wind strength, would necessitate a readjustment at the tiller or wheel. This type cannot be used on boats having an outboard rudder because of the unpredictable water turbulence.
4. Servo Pendulum - At the stern, the system consists of a wind vane controlling, through linkage, the angle of attack of a pendulum blade with the water. The blade is horizontally pivoted and its movement controls the main rudder via lines to the tiller or a drum mounted on the wheel. The linkage from the vane to blade is necessarily complicated. Also, when the rudder turns to put on weatherhelm, the pendulum blade has to rotate up towards the water surface, always on the windward side. This rotation is added to the heel angle resulting in the blade's lift falling drastically.

Disadvantages that are common to all of the above wind vane gears are as follows:

1. In addition to picking up the direction of the apparent wind, the vane must also provide operational torque for turning and holding at an angle of attack the primary rudder, auxiliary rudder, trim tab, or pendulum blade. Therefore, one side of the vane is always working against the wind. This results in the vane angle varying with wind strength, which contributes to boat oscillations. On horizontal and inclined axis vanes, a small vane is needed for heavy weather, and a larger vane is needed for light airs.

2. The relationship between the vane axis and the horizon varies with the boat heeling, thereby contributing to unsteady steering. The pitching at the stern, caused by the fore and aft motion of the boat, generates adverse rotary inertia at the counterweighted wind vane which also impairs steering.
3. A movement of the water level up or down, due to the pitching, heeling, or rolling of the boat, changes the surface area of the tab, aux. rudder, or blade in contact with the water, thereby affecting the performance of these components and the consequent steering steadiness.
4. The size of the tab, aux. rudder, or blade is related to its location, the primary rudder size, and the primary rudder location. Also, the size of the wind vane is related to the size of tab, aux. rudder, or blade. Sizing the self-steering system to a particular boat is not easy and would be a gamble for most boat owners. It could result in the boat being either oversteered or lack adequate steering control.
5. Control lines and pulleys connect the steering unit to the tiller or drum on the wheel, which clutter the deck and cockpit.
6. In many cases, it is not a simple operation to activate self-steering or change to manual operation.

The present invention exhibits the following advantages over the prior art:

1. The wind vane need only provide a directional fix on the apparent wind. The operational torque required at the rudder shaft is created completely at the hydraulic pump. The wind vane will therefore weathercock easily and be responsive even in light airs. Variation of wind strength, as related to the vane, does not effect steering and only one size vane is required for all boat sizes and wind speeds.
2. The hydraulic vane control unit, comprised of wind vane, pressure regulator, and water-driven pump, is pivoted at its stern support, thereby enabling the axis to always be perpendicular to the water surface, because of the counterweighted lower end. The vane remains upright, regardless of the boat heel angle. The pivot also keeps the pump well below the water surface at all times.
3. Only one size of hydraulic vane control unit will handle all sailboats with a length of 20 to 50 feet, regardless of weather and boat characteristics. By controlling the main rudder, adequate steering capability is assured. The bore diameter of the hydraulic cylinder and the length of rudder arm are varied with the size of boat. The boats of greater length or displacement will require the larger cylinder bore and longer rudder arm, thereby providing greater torque at the rudder and a slower rudder movement, which is required for the larger boats. When used with an outboard rudder, the steering steadiness will not be affected by the water turbulence in the area of the pump.
4. Below deck control of the rudder is provided, thus clearing the deck and cockpit of lines and pulleys.
5. The steering unit can be easily pivoted to a near horizontal position and secured for racing, anchoring, and unfouling of the submerged parts.
6. Activation of self-steering or changing to manual steering is easily accomplished, respectively, by releasing or securing a control line.

SUMMARY OF THE INVENTION

The general object of the present invention is providing an improved form of self-steering mechanism for sailboats, which may be readily mountable on the transom of a sailboat. A further general object of the present invention is to provide a steering mechanism for sailboats to enable the sailboat to be automatically steered in any desired direction relative to the apparent wind without human aid or any form of steering device which is based on the relative movement of the boat to the earth's magnetic field or the earth's meridians.

Hydraulic vane steering is a new concept of self-steering for sailboats. The system is comprised of four basic components, namely, a wind vane, a differential hydraulic pressure regulator, a water-driven hydraulic pump, and a hydraulic cylinder.

The hydraulic cylinder is located below deck, preferably, and it turns the rudder shaft through a rudder arm and roller. Two hydraulic lines connect the cylinder to the regulator. The regulator shaft turns a disk in the regulator which controls both oil pressure and direction of oil flow to the cylinder. The regulator shaft is connected to the wind vane through a clutch.

The differential hydraulic pressure regulator has two functions.

1. It controls the oil pressure at either end of a double acting hydraulic cylinder, and thereby establishes the rudder angle. The pressure is varied by either a change of wind direction, boat heading, or water speed.
2. It performs as a directional four way valve, determining whether the rudder angle is on the port side or starboard side, relative to the keel centerline.

Two inputs into the pressure regulator are internally combined, through a secondary differential means, to control the output, which is the size of dual orifices. One input is the apparent wind direction, which controls the wind vane and the grooved disk of the regulator. The other input is the boat heading, which operates through the fixed regulator body. The primary differential of the regulator has as one input, the control of orifice size, referred to above. The other input is the oil velocity, which is controlled by the water speed via the positive displacement pump. The output from the primary differential is oil pressure, which controls the rudder angle of attack with the water via the hydraulic cylinder.

The speed of the water-driven positive displacement pump is directly proportional to the water speed. Therefore, the oil velocity is directly proportional to the water speed. The power capability of the pump is directly proportional to the square of the water speed. A pressure relief valve limits the hydraulic pressure.

DESCRIPTION OF THE DRAWINGS

FIG. 1 is a side elevational view of a possible arrangement for mounting the hydraulic vane control unit on the stern of a sailboat;

FIG. 2 is a sectional view of the pivot shaft for the hydraulic vane control unit;

FIG. 13 is a sectional view of the water driven pump;

DESCRIPTION OF THE PREFERRED EMBODIMENTS

Figure 7:
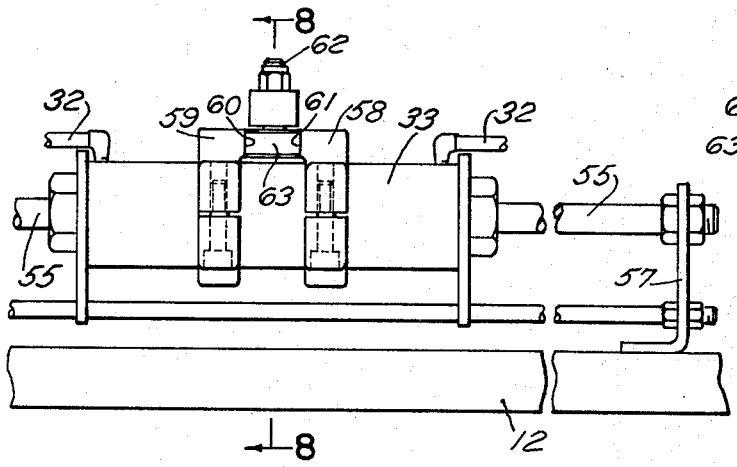
FIG. 7 is a fragmental elevation of the hydraulic motor.
Figure 8:
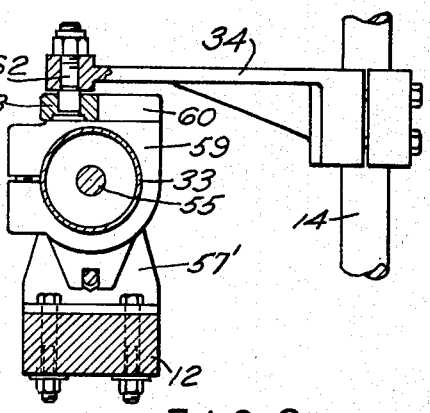
FIG. 8 is a section on line 8—8 of FIG. 7 showing the hydraulic motor connected to the rudder post.
Figure 9:
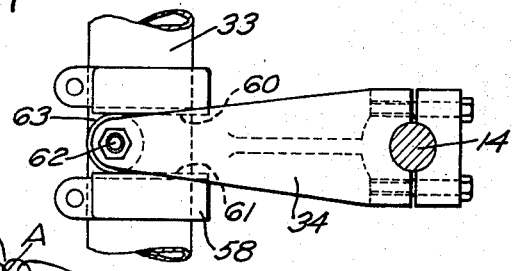
FIG. 9 is a plan view of the showing of FIG. 8.

Referring to FIG. 1 there is shown the aft portion 10 of a sailing vessel having a backstay 11, a transom 12, rudder 13 and rudder post 14. A hydraulic vane control unit designated generally 15 is supported on the transom by a bracket designated generally 16 having a post 17 fixedly secured by clamps 18 bolted to the transom. This bracket has a horizontally extending arm 20 adjustably mounted on the post 17 by means of a connection 21 for locating the arm for horizontal extension from the post 17. This arm 20 extends rearwardly from the transom 12 and then laterally at substantially right angles 20'. A bracket 22 is clamped to the arm portion 20' and mounts a pivot shaft 23 (see FIG. 2) on which ball bearings 24 mount the casing 25 which carries the hydraulic vane control unit. This unit is freely rockable about this horizontal pivot shaft 23 and has a leg 26 depending therefrom to support a hydraulic pump 27 located beneath the surface of water 28 and which pump is actuated by a propeller 29 as the pump is moved through the water to pump hydraulic liquid, in this case oil, through lines 30 to a differential hydraulic pressure regulator designated generally 31, and thence by flexible conduits 32 to a hydraulic motor 33 within the hull 10, which through an arm 34 connected to the rudder post swings the rudder post and in turn the rudder 13 in response to hydraulic motor pressure supplied through the hydraulic pressure regulator 31. A wind vane 40 having a counterweight 39 is connected to a stem 41 fitting upon and clutched or de-clutched to a control shaft 50 for operation of this shaft which in turn controls the ports of the pressure regulator 31. This entire wind vane assembly 39, 40, 41 is mounted for rotation about a vertical axis by means of a depending housing 41 that fits over a control shaft 50 that passes into a differential hydraulic pressure regulator 31. Hydraulic connections are shown between the hydraulic pump 27 and the hydraulic pressure regulator 31 by means of a pair of hoses 30 and, in turn, the output of the hydraulic pressure regulator within housing 51 is connected to a hydraulic motor 33 by means of a pair of conduits 32. The hydraulic motor 33 is most conveniently a double-acting hydraulic cylinder 33, and by referring to FIGS. 7 and 8, a typical way of utilizing the hydraulic motor on the rudder post has been illustrated. Here the double-acting cylinder 33 has a cyliner rod 55, extending from either end thereof, the ends of the rod being fixedly mounted in brackets 57, 57' fixed to the hull of the sailboat and generally near the rudder post 14. The body of the cylinder 33 is provided with a pair of collars 58, 59 having flat spaced surfaces 60, 61 receiving between them an upstanding post 62 with resilient means 63 surrounding it which is located on the end of a rudder post arm 34 fixed to rudder post 14. Hoses 32 pass thru the transom 12 and are connected to fittings at either end of cylinder 33 so as to effectively apply hydraulic pressure to either side of the piston while relieving pressure on the opposite side as well understood to those skilled in the art, and in this fashion the entire cylinder 33 moves on the piston rod 55 and will move the arm 34 and rudder post 14.

For an understanding of the operation of the hydraulic pressure regulator and its coupling to the wind vane, reference should now be had to FIGS. 3 thru 13. The pump 27 has located at the forward end thereof a multi-blade propeller 29 which is mounted on a shaft 71 that is supported for rotation by roller bearings 72 and ball bearing 73 in the housing and has driving engagement with a positive displacement pump located as indicated generally by the numeral 74. Cap 75 is shaped as a hydrofoil and encloses hydraulic fluid chamber, into which the pressure relief valve may discharge, and which connects with the fluid return conduit of the pump. A shaft seal is located at 76.

The interior of the housing 41 is delineated by a conical bore section 42 (FIG. 3) which is adapted to receive in frictional engagement therewith a mating conical member 77 that is received on a central control shaft 50, the upper portion of which is designated as 50'. The housing 41 is received about this central shaft in a ball bearing 79 and bushing 80, the latter of which is adapted to slide longitudinally on the shaft portion 50'. The cone means 77 is fixed to the shaft by pin 78 so as to rotate therewith and remain physically fixed thereto, while the slidable bushing 111 embraces the upper portion 50' of the shaft 50 to provide additional support for the stem 41 about the shaft. A spring 80' acts between the bearing 79 and the cone 77.

Figure 3:
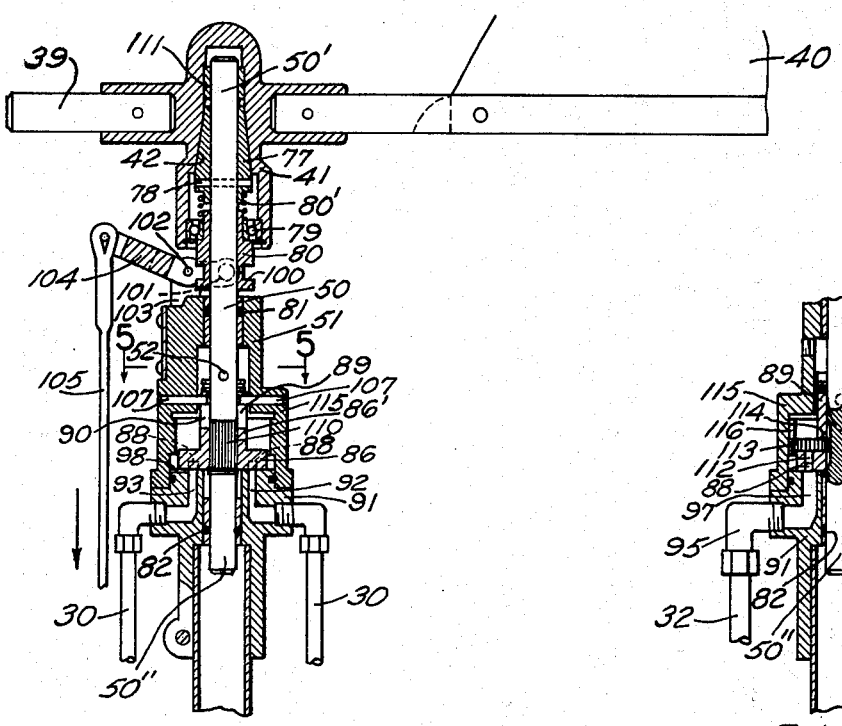
FIG. 3 is a vertical section of a portion of the regulator mechanism.
Figure 4:
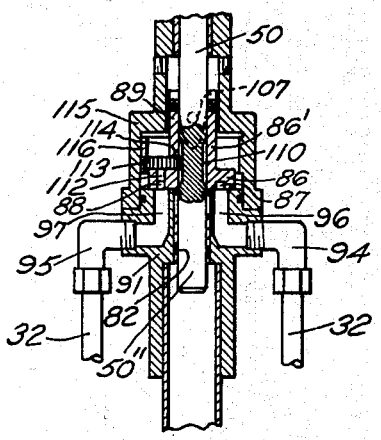
FIG. 4 is a section similar to FIG. 3 but at right angles thereto.
Figure 5:
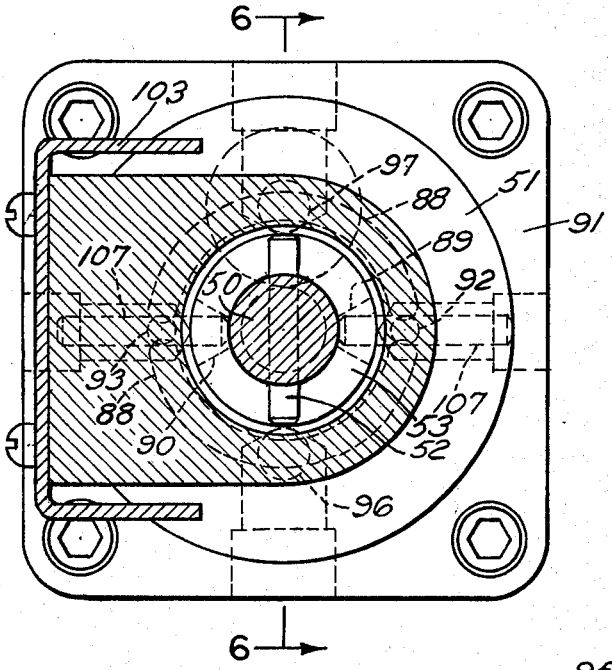
FIG. 5 is an enlarged sectional view on line 5—5 of FIG. 3.

The shaft 50 extends into the regulator housing 51,115 and is sealed for reciprocation and rotation therein by O-rings 81 and 82 (FIG. 3). This lower portion of the shaft 50 is designated 50''. The movable member of the regulator comprises a disk 86 (FIG. 3) which has a hub 86' extending upwardly therefrom. The disk 86 has a pair of semi-circular grooves therein 87 and 88 (FIG. 6) and on the hub portion 86', the end thereof is tapered into a pair of cam surfaces 89, 90. The control shaft 50 has gear teeth cut therein as at 110. A stub shaft 112 is mounted in the disk 86 and extends upwardly therefrom and has a planetary gear 113 located on this shaft. Gear 113 extends thru a slot 114 in the hub 86' to engage the teeth 110. The lower housing 115 also has internal gear teeth 116 cut therein with which the planetary gear engages. Thus, as the control shaft rotates, the gear teeth 110 turn the planetary gear 113 which, being in mesh with the teeth 116 rotate the disk 86 and cause the port orifices to increase or decrease in size for the passage of the hydraulic fluid. The planetary gearing system provides an approximate five to one reduction of movement between shaft 50 and disk 86, thereby providing precise control of the dual orifice size and consequent oil pressure. The lower portion of the pressure regulator comprises the mating stationary plate 91, and in this mating plate are a pair of ports 96, 97 which communicate respectively with the grooves 87 and 88 and also to piping connection means 94, 95 that in turn lead by conduits 32 to the hydraulic motor 33. Additionally, the stationary plate 91 has additional pair of ports 92, 93 (FIG. 3) and these connect to the pressure side and the return side of the pump by hoses 30. Preferably the contact surfaces of the movable part of the regulator member 86 and the fixed portion of the regulator member 91 will be flat and smooth so that a good seal is maintained and the leakage of oil is minimized. The upper side of disk 86 is pressurized by a leakage groove 98 at pressure port 93 and further mating pressure of the contact surfaces of the parts 86 and 91 is provided by the dowel pin 52 resting on thrust anti-friction bearing 53.

Figure 6:
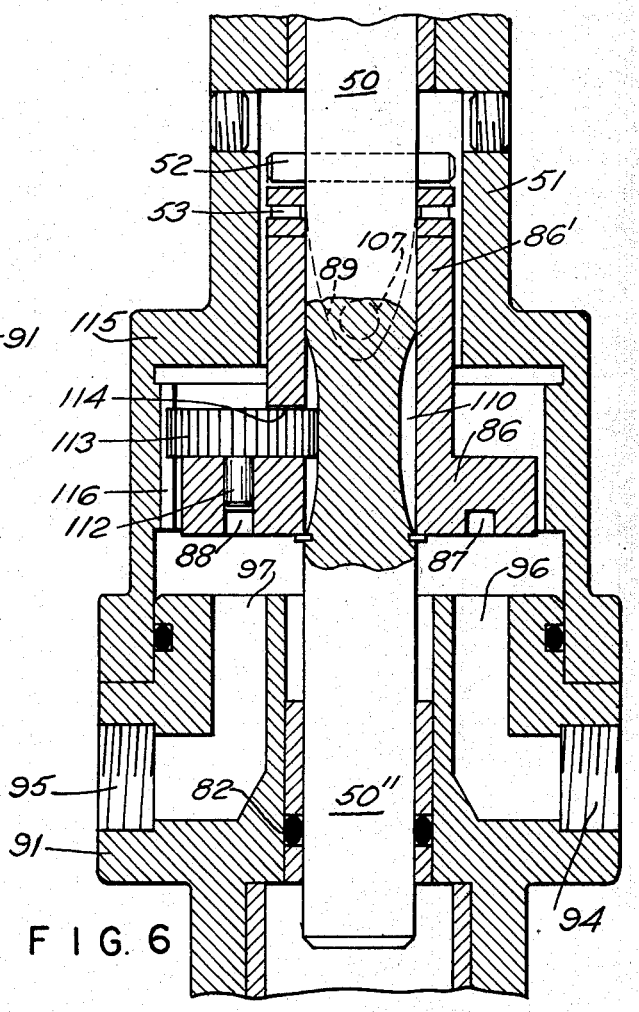
FIG. 6 is a fragmental sectional view enlarged from that of FIG. 4 showing the hydraulic pressure regulator.

The central portion of the shaft 50, as has been mentioned before, is embraced by a bushing or sleeve 80 (FIG. 3) which sleeve has a groove 100 therein that receives a pair of cam pins 101 that are part of a yoke that embraces the groove 100 which yoke is pivoted about a fixed pivot 102 on a bracket 103 (FIG. 3) fixed to the housing 51 and is controlled by an arm 104 and a line 105 attached to the free end of the arm. It is thence led about a sheave 106 (FIG. 2). When the rope 105 is pulled in the direction of the arrow the yoke will raise the bushing 80 (FIG. 3) and the shaft 50 which then moves the regulator disk 86 (FIGS. 3, 6) away from the lower stationary plate 91 as seen in FIG. 6, and makes a discontinuous conduit to and from the pump by virtue of the fact that grooves in the plate are now out of control. The disk 86 will be moved into a central position as the cam portions 89, 90 (FIG. 6) of disk hub 86' engage locating pins 107 (FIG. 3) and now lock the disk 86 into a fore and aft position. In other words, locationwise, the grooves in the underside of disk 86 are centrally oriented with respect to the ports in the lower plate 91 as diagrammatically illustrated in FIG. 10 of the drawings. When disk 86 is raised there will be equal pressure on opposite sides of the piston of motor 33 because the hydraulic fluid can pass freely between ports 96 and 97 and thereby permit manual steering of the boat by either tiller or wheel. When the bottom of cam surfaces 89 and 90 strike locating pins 107 (FIG. 3), further upward movement of disk 86 and shaft 50 is prevented. Continued pulling on rope 105, and securing by a jam cleat, will slide and raise sleeve 80 on shaft 50 until the upper end of sleeve 80 strikes the lower end of conical portion 77. When this occurs, the spring 80 is compressed between the inner race of the ball bearing and the lower end of conical portion 77, thereby removing engagement of conical portion 77 from its mating surface 42. The housing 41 with the wind vane is now free to move in any direction and will normally lie into the wind.

Figure 10:
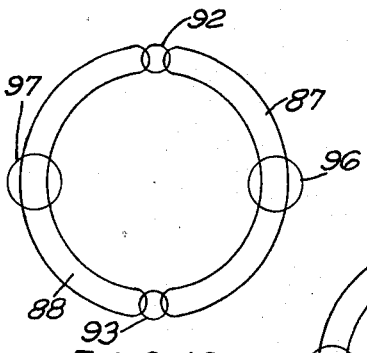
FIGS. 10, 11, and 12 are diagrammatic views representing various positions of the disk grooves relative to the ports of the hydraulic pressure regulator.
Figure 11:
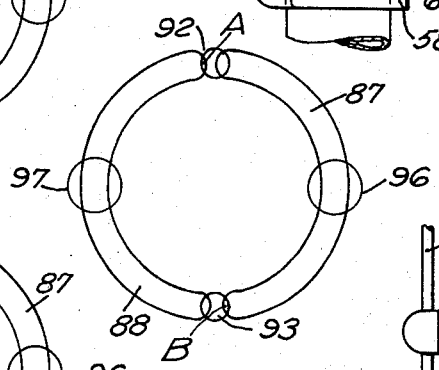
Figure 12:
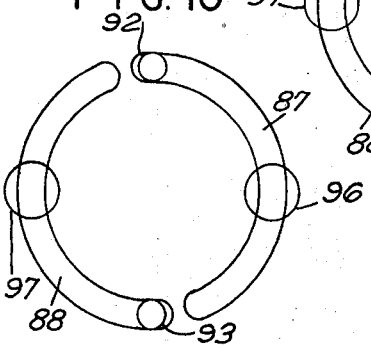

In the operative use of the steering device, the sailboat is placed on the desired sailing course, and the sails are trimmed with the wind. The line 105, which has been previously referred to as disconnecting the device in an inoperative condition, may be released to first lower the wind vane and housing 41 bringing into engagement the conical portion 77 and its mating surface 42. In so doing, spring 80' expands and holds the two tapered surfaces together. The entire assembly of vane 40, housing 41, shaft 50, and disk 86 are lowered by continued release of rope 105, bringing into contact the lower surface of disk 86 and the upper surface of plate 91 through the weight of the parts on shaft 50 acting through dowel pin 52 and bearing 53 (see FIG. 3). As was noted previously in the disengaged position, a neutral arrangement has been provided and it is locked in with the wind vane before the disk is lowered; that is, the ports 92 and 93 (FIG. 5) each align with a portion of the grooves 87 and 88 to the balanced condition as diagrammed in FIG. 10 of the drawings. When a balanced condition is referred to in connection with a sailboat, it means that the force working at right angles to the sail as related to the center of lateral resistance of the hull shape including the keel and/or centerboard in such that little or no turning moment is created; that is, a tendency for the boat to either round up into the wind or fall off giving, respectively, what is known to those skilled in the art as a weather helm and a lee helm. This means effectively that, when the pump is operating in the condition of FIG. 10, equal oil pressure is applied to the two sides of the double-acting hydraulic motor 33 in the form of a hydraulic cylinder and no movement of the rudder will be anticipated since everything is in balance. Now let us assume that the boat is on the starboard tack and it has a slight weather helm. When this condition exists, the arrangement of FIG. 11 will effectively be the balanced non-hunting condition. In this case oil will flow from the pump into port 93, and the supply of oil to the pump comes completely from the port 92. The slight opening as at A and at B in FIG. 11 restricts the flow of oil to the port 92, and the buildup of a pressure in the recess 88 can be varied by the relative rotary movement of the regulator disk. This chamber 88 is also, of course, connected to one side of the hydraulic motor 33. In this condition of sailing a balanced condition exists when the portion of the openings that are created and designated A and B create the proper oil pressure for transmission to the hydraulic motor 33 through the port 97 to hold the rudder at the required angle for maintaining the boat on a straight course. Of course, the greater the weather helm, the greater will be the rudder angle and oil pressure. When the rudder is at an angle, the water strikes same thereby transmitting a force to the connecting hydraulic motor which creates an oil pressure in the hydraulic system. This pressure is maintained by the impeller providing the required torque to the pump. Now if the boat is knocked off course in excess of approximately 15 degrees by wave action, the relationship of the regulator disk 86 to the ports 92 and 93 would be as shown in FIG. 12 of the drawings. All of the oil that is supplied by the pump to the port 93 is now directed out to the port 97 that connects to the hydraulic motor and all of the return now to the hydraulic pump is from the port 96 which connects with port 92 and the pump. This action creates motion in the hydraulic motor and changes the rudder angle and tends to bring the boat back on course again to a balanced non-hunting condition either as shown in FIGS. 10 or 11.

It should be remembered that the hydraulic pump 27 is operated by a water driven impeller which, of necessity, has to be of sufficient size to provide the requisite hydraulic pressure which is required to control the rudder. The pitch of the blades should be such as to provide a blade tip speed substantially equal to the water speed. It is known in sailboats that as the wind velocity increases, the amount of rudder torque or helm increases as the square of the hull speed. Likewise the power capability of the impeller is proportionally increased as the square of the water velocity thereby providing the capability of creating the oil pressure required to hold the rudder at the proper angle for maintaining the boat on a straight course.

Figure 14:
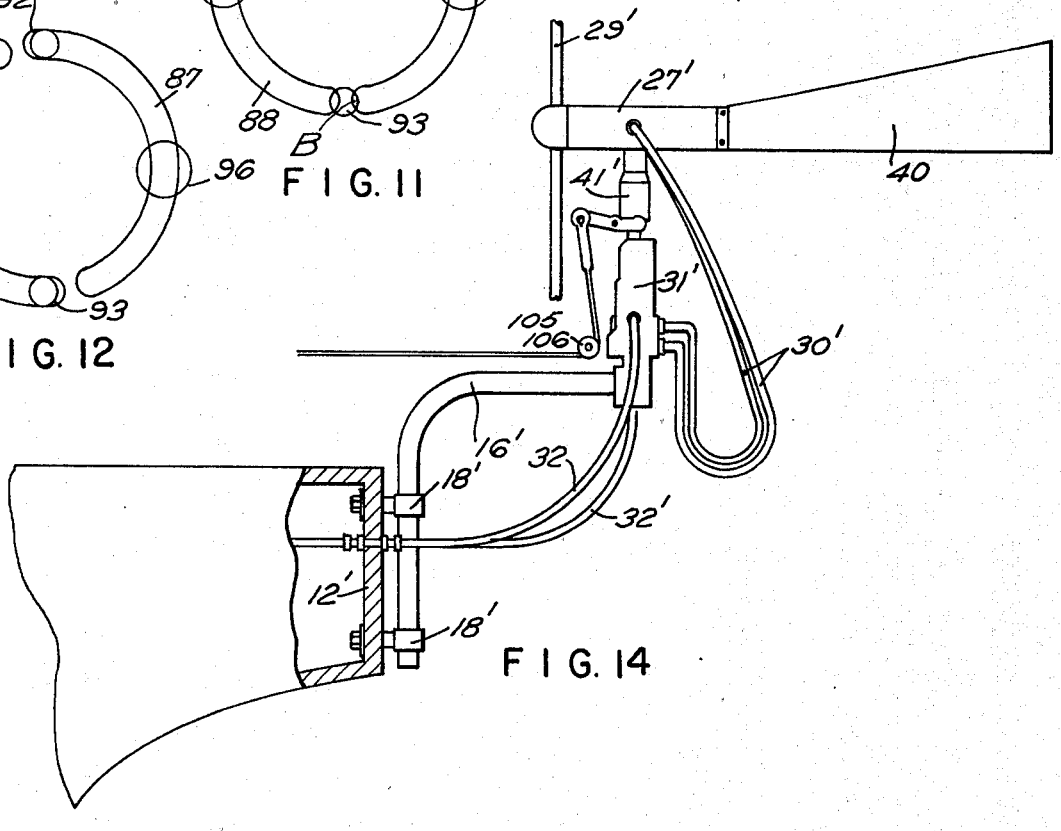
FIG. 14 is a side elevation of a modified arrangement showing the pump as wind driven.

In FIG. 14 of the drawings a modified arrangement is shown wherein the hydraulic pump 27' is driven by the wind through a propeller 29' instead by the water as in the previous embodiment. This assembly of pump and wind vane 40 has a housing 41' which is mounted on the control shaft as heretofore described, the differential hydraulic pressure regulator 31' being controlled by the control shaft as heretofore. The wind vane 40 keeps the impeller 29' on pump 27' into the wind so as to be driven by the air, a fluid through which the vessel moves. Hydraulic fluid is supplied from the pump 27' through the conduits 30' to the differential hydraulic pressure regulator 31' and from the regulator through conduits 32' to the hydraulic motor located within the boat and as heretofore designated 33. This whole unit is mounted on the stern of the boat by bracket 16' in a manner similar to that heretofore shown through brackets 18' which are clamped to the transom 12'. The control is otherwise the same as heretofore above described.

I claim:

1. A steering mechanism for a sailboat that moves through a fluid comprising a hydraulic motor, said motor being operatively connected to a boat rudder, a fluid-driven hydraulic pump, said pump having a driving impeller, said impeller being in the fluid through which the boat moves to drive the impeller, the speed of the impeller being in part proportional to the forward velocity of the hull of the boat, a wind vane mounted for rotation about a substantially vertical axis, a differential hydraulic pressure regulator having a body and an operator section, one of which is operatively coupled to said wind vane, the other of which is fastened to the boat, the discharge of said pump being operably connected to said motor through said regulator, the suction of said pump being operably connected to said motor through said regulator, whereby said wind vane controls said steering mechanism.

2. A mechanism as in claim 1 wherein there is a means to operatively declutch the wind vane from operation.

3. A mechanism as in claim 1 wherein there is a means to operatively declutch the wind vane from operation and decouple the pump.

4. In a steering mechanism the combination of a wind vane mounted for rotation about a substantially vertical axis about a shaft, a wind-driven hydraulic pump mounted on the wind vane, a clutch means including one axially movable element between the wind vane and shaft, and control means coupled to said shaft for controlling a boat rudder, a movable means coupled to the shaft for decoupling the control means and the clutch whereby upon movement thereof the wind vane is free to rotate and the control means for the rudder is decoupled, decoupling of the control means also decoupling the pump.

5. A steering mechanism for a sailboat having a rudder, comprising a hydraulic motor, means for operatively connecting said motor to the boat rudder, a water driven hydraulic pump, conduit means connecting said pump to said motor, a differential hydraulic pressure regulator interposed in said conduit means for controlling flow and pressure of hydraulic fluid to said motor, a wind vane, and means connecting said wind vane to said regulator for varying the pressure to said motor.

6. A mechanism as in claim 5 wherein the means connecting the wind vane to said regulator includes a clutch and wherein the pump and motor may be hydraulically decoupled from said regulator.

7. A mechanism as in claim 5 wherein the hydraulic pump, regulator and wind vane are physically mounted together as a unit, the wind vane being rotatably mounted at the upper end of the unit and the pump being mounted at the lower end of the unit, said unit pivotally secured to the sailboat whereby regardless of boat heel angle, said unit remains substantially perpendicular.

* * * * *